United States Patent [19]

Braun et al.

[11] 4,141,593

[45] Feb. 27, 1979

[54] COAL PLANE WITH CHAIN OPERATED TURNING HEAD

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 802,435

[22] Filed: Jun. 1, 1977

[30] Foreign Application Priority Data

Jun. 18, 1976 [DE] Fed. Rep. of Germany ..... 2627484

[51] Int. Cl.[2] ..... E21C 27/34

[52] U.S. Cl. ..... 299/34; 299/80

[58] Field of Search ..... 299/32, 34, 80

[56] References Cited

U.S. PATENT DOCUMENTS

| | | | |
|---|---|---|---|
| 2,699,930 | 1/1955 | Löbbe | 299/34 |
| 2,745,651 | 5/1956 | Herrmann | 299/80 |
| 2,823,908 | 2/1958 | Rösler | 299/34 |
| 3,305,269 | 2/1967 | Löbbe et al. | 299/34 |

FOREIGN PATENT DOCUMENTS

| | | | |
|---|---|---|---|
| 192133 | 4/1967 | U.S.S.R. | 299/34 |
| 255158 | 3/1970 | U.S.S.R. | 299/34 |
| 264306 | 6/1970 | U.S.S.R. | 299/34 |
| 266684 | 7/1970 | U.S.S.R. | 299/34 |

*Primary Examiner*—Ernest R. Purser
*Assistant Examiner*—Nick A. Nichols, Jr.
*Attorney, Agent, or Firm*—McGlew and Tuttle

[57] ABSTRACT

A coal plane for use against a coal face, comprises a plane body which has a plane guide. A plane chain is arranged in the plane guide and has chain ends engaged on respective sides of the plane body. A bit support is mounted in the plane body for pivotal movement about a vertical axis in a working direction toward the coal face. A horizontal control shaft, mounted orthogonally to the longitudinal direction of the plane chain on the plane body, is provided, to actuate the bit support. A turning head is mounted on a control shaft for rotation therewith and it operates between two spaced apart slide plates. A lever arm is secured to the control shaft for rotation therewith and a control chain mounted for reciprocating motion is engaged with the lever arm and is connected to the ends of the plane chain. The control chain acts on the plane body with a clearance of motion in order to transform a reciprocating movement of the control chain in dependence on the pulling direction of the plane chain during pivoting of the turning head on the control shaft into a pivotal movement of the bit support about its vertical axis in a working direction toward the coal face.

5 Claims, 4 Drawing Figures

COAL PLANE WITH CHAIN OPERATED TURNING HEAD

FIELD AND BACKGROUND OF THE INVENTION

This invention relates in general to coal mining devices and, in particular, to a new and useful coal plane with a plane body comprising a plane guide and including a plane chain arranged in the plane guide which acts with its chain ends on both sides of the plane body.

DESCRIPTION OF THE PRIOR ART

A constant problem with coal planes is to obtain a satisfactory engagement of the planing tool in the coal face to be mined. For this purpose, it is known to use pivotally mounted bits which frequently fail in use, however, because the bits dig into the coal face in different lengths and thus cause irregular cuts. This is particularly true if a pivotally mounted ground rocker arm is provided in addition to the bit. The digging of the bits into the coal face is substantially due to the passive engagement of the bit and of the ground rocker arm. Passive engagement means the uncontrolled swinging of bit and ground rocker arm machines due to transverse forces appearing between the coal face and the plane body or ground rocker arm. Thus, an exact engagement depth is not given. Beyond that, the use of known coal planes is extremely problematic, particularly with steep stratification, because the labile bit position between the face and plane is jeopardized there.

SUMMARY OF THE INVENTION

The present invention provides a coal plane which is characterized by an active and controlled engagement of bits with the coal face to be mined even with steep stratification. The bit support can be swung out about a vertical axis in a working direction toward the coal face and a horizontal control shaft is mounted in the plane body orthogonally to the longitudinal direction of the chain to actuate the bit support which carries a turning head working between two sliding plates on the bit support and which also engages with a lever arm control chain, connected to the chain ends of the plane chain, and acting on the plane body with a clearance of motion. It thus transforms a reciprocating movement of the control chain, in dependence on the pulling direction (and thus working direction) of the plane chain over a turning movement of the turning head about its horizontal control shaft, into a pivotal movement of the bit support about its vertical axis in the working direction toward the coal face. These measures of the invention have the result that, by starting the plane chain over the control chain, the bit support on the plane body can be swung out toward the coal face so that a neutral position of the bit is achieved. When the bit is engaged, it is thus no longer important that there are coal fragments between the coal face and the plane body. There is rather an active engagement which is controlled in dependence on the pulling direction and thus working direction of the plane over the control chain between the two ends of the plane chain. It is also possible to arrange the plane body either before or behind a bulldozer.

In one embodiment of the invention, the lever arm of the control shaft is connected to the control chain without any clearance of motion so that the clearance of the control chain on its chain holders is fully utilized for the respective reversal by tightening the plane chain. In a preferred embodiment of the invention, a fork head is mounted in the bit support for rotation with the bit support about a vertical axis. The fork head acts on the ground rocking arm arranged beneath the bit support for pivotal movement about a bearing pin on the plane body upwardly inclined in orthogonal position to the longitudinal direction of the chain toward the floor and coal face. The fork head has two fork ends, between which a vertical turning nose slides on the ground rocker arm and transforms the pivotal movement of the fork head about its vertical axis into a pivotal movement of the ground rocker arm about its substantially horizontal bearing in the same working direction. Consequently, not only the bit carrier, but also the ground rocker arm is extended by a certain distance, according to the invention, so that the bits engage the floor by a controlled amount. Digging of the bits into the coal face, or the floor, by adjustable sliding blocks is impossible and a change of direction with the use of the plane of the invention is always possible. The upwardly inclined arrangement of the bearing pin for the ground rocker arm is provided so that it has, by mere lifting, a free cutting angle not only with the floor but also with the coal face, because the ground rocker arm works in the transition range from the floor to the coal face and must be able to be extended and retracted in this range.

The turning head and the turning nose are crowned, so that a satisfactory relative movement between the sliding walls of the bit support and the fork head in the course of the engagement and disengagement of bit support fork head and ground rocker arm is possible. According to the invention, the forked head can be equipped with tracing knives for forming a tracking head. Stops are arranged in a plane of the body in a preferred embodiment of the invention which comprise adjustable sliding blocks for the turning nose of the ground rocker and which are located at both sides of the turning nose. By this means, the vertical position of the ground bits can be varied at will, so that the upper cut and under cut of the coal plane, according to the invention, can be determined. The cutting force of the forked head is designed as a tracking head and is supplied to the ground rocker arm over the fork ends and the turning nose to form a non-positive engagement. The stops for the turning nose of the ground rocker arm are designed preferably as sliding blocks. Finally, the invention provides that the plane chain acts in the cutting center of the bit arrangement on the plane body, to ensure equilibrium of movement.

An advantage of the invention is that a coal plane is obtained whose bit supports and ground rocker arm are characterized by active engagement of the coal face to be mined, because they are turned out over a control chain by a given amount toward the coal face in a working direction. This results in a controlled depth of engagement of the bits, even in steep stratification. A change of direction is ensured by the coal plane according to the invention. The coal plane according to the invention ensures trouble-free mining operations, and thus more rational and economical production of coal than heretofore obtained with the prior art constructions.

Accordingly, it is an object of the invention to provide a coal plane for use against a coal face in which there is a control chain which is mounted for reciprocating motion and engaged with a plane chain which acts on a plane body with a clearance of motion in order to transform a reciprocating motion of the control chain in dependence on the pulling direction of the plane chain during pivoting of a turning head on a control shaft into a pivotal movement of the bit support about a vertical axis in a working direction toward the coal face.

A further object of the invention is to provide a coal plane which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
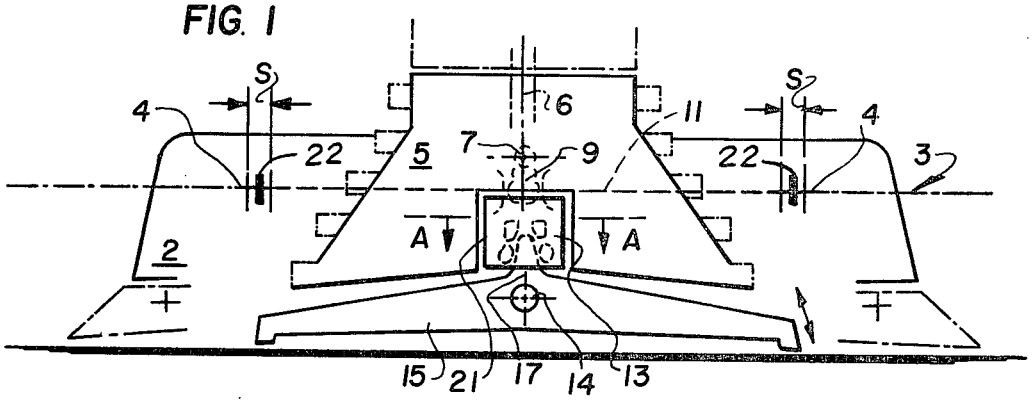
FIG. 1 is a schematic front view of a coal plane constructed in accordance with the invention.
Figure 2:
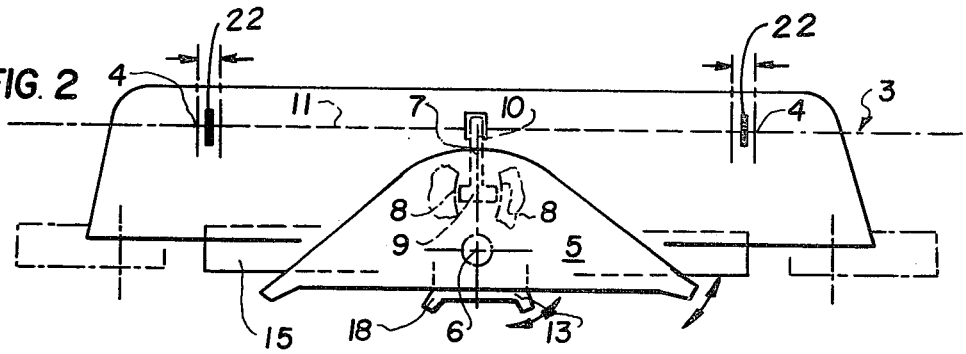
FIG. 2 is a top view of the coal plane of FIG. 1.
Figure 4:
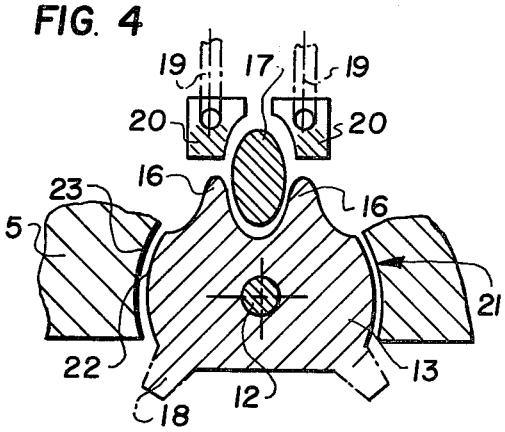
FIG. 4 is a section taken along the line A—A of FIG. 1.
Figure 3:
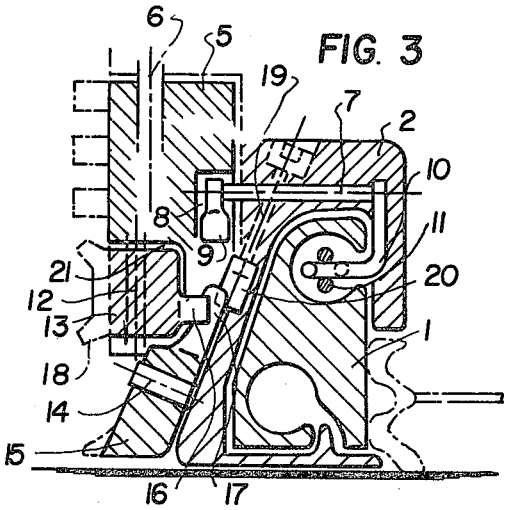
FIG. 3 is a schematic vertical sectional view of the coal plane.

Referring to the drawing in particular, the invention embodied therein comprises a coal plane for use against a coal face. The drawings show a coal plane with a plane body 2 comprising a plane guide 1 (FIG. 3) including a plane chain 3 (FIGS. 1 and 2) which extend through side parts of the plane body 2 and is also arranged in the plane guide 1. The plane chain 3 has chain ends or engagement pieces 4 disposed adjacent both sides of plane body 2. Plane body 2 includes fixed members 22 adjacent engagement pieces 4 which engage with engagement pieces 4 when plain chain 3 is moved through a clearance S. A bit support 5 is mounted in plane body 2 for pivotal movement about a vertical axis 6 in a working direction toward the coal face. A horizontal control shaft 7 is mounted orthogonally to the longitudinal direction of the plane chain 3 to actuate the bit support 5 in plane body 2. Bit support 5 carries a turning head, working between two slide plates 8 on bit support 5 and engages a control chain 11 with its lever arm 10. The lever arm 10 is also connected to the chain ends 4 of the plane chain 3 acting on plane body 2 with clearance of motion S through a control chain 11. This has the effect that a reciprocating movement of control chain 11 is transformed in dependence on the pulling direction of plane chain 3 over a pivotal movement of turning head 9 about its horizontal control shaft 7 into a pivotal movement of bit support 5 about its vertical axis 6 in working direction toward the coal face.

Lever arm 10 of the control shaft 7 is connected to control chain 11 without clearance of motion. A forked head 13 is mounted in the bit support 5 for pivotal movement with the bit support about a vertical axis 12, which acts on a ground rocker arm 15 arranged underneath bit support 5. The arm 15 is mounted for pivotal movement about a bearing pin 14 on the plane body 2 and it is upwardly inclined in an orthogonal position to the longitudinal direction of the chain, in a working direction toward the floor and the coal face. The rocker arm 13 has two fork ends 16 between which a vertical turning nose 17 slides on ground rocker arm 15 which transforms the pivotal movement of the forked head 13 about its vertical axis 12 into a pivotal movement of ground rocker arm 15 about its substantially horizontal bearing pin 14 in the same working direction.

When plane chain 3 therefore is pulled in one direction or the other, it instantaneously actuates lever arm 10 through control chain 11 and after it moves through the clearance S plane chain 3 engages with and pulls plane body 2 by the engagement of engagement pieces 4 with the fixed members 22 on plane body 2.

Turning head 9 and turning nose 17 are crowned to improve their sliding properties. Forked head 13 can be equipped with tracing knives 18 and is consequently designed as a tracing head. Stops are arranged in plane body 2 in the form of sliding blocks on both sides of ground rocker arm 15 which are assigned to adjusting spindles 19 for turning nose 17. Forked head 13, mounted in a recess 21 of bit support 5, bears with its crowned sliding surface 22 against the side walls 23 of recess 21 and can thus perform a movement relative to the bit support 5 but it can be entrained by the bit support in its pivotal movement. Plane chain 3 acts on the plane body 2 in the cutting center of the bit arrangement.

While a specific embodiment of the invention has been shown and described in detail to illustrate the application of the principles of the invention, it will be understood that the invention may be embodied otherwise without departing from such principles.

What is claimed is:

1. A coal plane for use against a coal face, comprising a plane body having a plane guide, a plane chain arranged in said plane guide having chain ends engaged on respective sides of said plane body, a bit support mounted in said plane body for pivotal movement about a vertical axis in a working direction toward the coal face, a horizontal control shaft mounted orthogonally to the longitudinal direction of said plane chain on said plane body to actuate said bit support, a turning shaft on said control head rotatable therewith, means defining two spaced apart slide plates on said bit support engaged with said turning head, a lever arm secured to said control shaft for rotation therewith, a control chain mounted for reciprocating motion and engaged with said lever arm and connected to the ends of said plane chain acting on said plane body with clearance of motion for transforming a reciprocating movement of said control chain in dependence on the pulling direction of said plane chain during pivoting of said turning head on said control shaft into a pivotal movement of said bit support about said vertical axis in a working direction toward the coal face.

2. A coal plane, according to claim 1, wherein said lever arm is connected to said control shaft without any clearance or motion.

3. A coal plane, according to claim 1, including a forked head mounted in said bit support for pivotal movement with said bit support about a second vertical axis, a rocker arm mounted for pivotal movement on said plane body beneath said support and upwardly inclined in an orthogonal position in respect to the longitudinal direction of said plane chain in a working direction toward the floor and the coal face, said forked head having two fork ends, a turning nose on said rocker arm engaged between said two fork ends, pivotal movement of said forked head about said second vertical axis being transformed into a pivotal movement of said rocker arm about its horizontal axis in the same working direction.

4. A coal plane, according to claim 3, wherein said forked head is equipped with tracing knives.

5. A coal plane, according to claim 3, including a sliding block stop arranged on each side of said rocker arm, an adjustment spindle connected to each of said blocks for shifting them to adjust said turning nose, said bit support having a recess in which said forked head is mounted, said forked head having a sliding surface on each side engaged in the recess of said bit support.

* * * * *